US006116945A

United States Patent [19]

Davis et al.

[11] Patent Number: 6,116,945

[45] Date of Patent: Sep. 12, 2000

[54] MICROPHONE CONNECTOR ASSEMBLY

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 09/193,795

[22] Filed: Nov. 17, 1998

Related U.S. Application Data

[60] Provisional application No. 60/070,040, Dec. 30, 1997.

[51] Int. Cl.[7] ..... H01R 13/59

[52] U.S. Cl. ..... 439/462; 439/354; 439/598

[58] Field of Search ..... 439/462, 461, 439/353, 354, 598, 904, 905, 289, 291, 460, 597

[56] References Cited

U.S. PATENT DOCUMENTS

| | | | |
|---|---|---|---|
| 4,647,127 | 3/1987 | Weingartner | 339/289 |
| 4,657,327 | 4/1987 | Weingartner | 339/289 |
| 5,211,576 | 5/1993 | Tonkiss et al. | 439/462 |
| 5,336,108 | 8/1994 | Lin | 439/462 |
| 5,362,252 | 11/1994 | Lin | 439/462 |
| 5,368,502 | 11/1994 | Lin | 439/462 |
| 5,564,942 | 10/1996 | Lee | 439/462 |
| 5,632,655 | 5/1997 | DeMarco, Jr. | 439/655 |
| 5,683,273 | 11/1997 | Garver et al. | 439/784 |

*Primary Examiner*—Khiem Nguyen
*Assistant Examiner*—Son V. Nguyen
*Attorney, Agent, or Firm*—Michael Aronoff

[57] ABSTRACT

An electrical connector assembly having complementary plug and receptacle subassemblies (100, 300) of similar construction. Each of the subassemblies includes a shell (110, 310) wherein the rear portion (126) has a longitudinal section removed therefrom, with the remaining rear portion of the shell subtending an arc of approximately 180°. A strain relief member (116) of generally semi-cylindrical configuration is adapted for placement relative to the shell so that it substantially replaces the removed longitudinal section of the shell. The rear end (126) of the shell and the rear end of the strain relief member each have a projection (134, 154) directed toward the other, with the projections being angularly and longitudinally offset from each other. A boot (118) is fitted over the shell (110) and the strain relief member (116) and engages the strain relief member to move its rear end toward the shell so that the two projections (134, 154) operate to secure and provide strain relief for a cable (180) exiting the subassembly (100).

24 Claims, 6 Drawing Sheets

MICROPHONE CONNECTOR ASSEMBLY

This application claims Benefit of Provisional application Ser. No. 60/070,040 filed Dec. 30, 1997.

FIELD OF THE INVENTION

This invention relates to electrical connector assemblies and, more particularly, to such an assembly which is suitable for use with a cable connected to a microphone.

BACKGROUND OF THE INVENTION

Microphone cables generally include three insulated wires and either a braided shield surrounding the insulated wires or a bare drain wire running alongside the insulated wires. Connectors for such a cable are typically generally cylindrical and include strain relief for the cable, individual contact members for the insulated wires, and some means for connecting the braided shield or the drain wire of a first cable to the corresponding element in a second connecting cable. What is desired is to have such a connector assembly which is easy to assemble, is of low cost, and provides improved shielding.

SUMMARY OF THE INVENTION

In accordance with the principles of this invention there is provided an electrical connector assembly of matable plug and receptacle connectors at least one of which comprises a generally cylindrical hollow conductive shell, at least one elongated conductive contact member, at least a first insulative contact housing, an insulative strain relief member, and a hollow generally cylindrical boot. The outer surface of the shell has threads thereon in a region intermediate its forward mating and rear ends to which the boot is affixable. The shell has a longitudinal section removed therefrom rearwardly from the threaded region to the rear end, with the remaining rear portion of the shell subtending an arc of approximately 180°. The contact housing is sized to fit within the shell forwardly of the removed section, and the contact housing and the shell are formed with complementary features to prevent rotation of the contact housing within the shell and to limit forward movement of the contact housing within the shell. The strain relief member is of generally semi-cylindrical configuration and is adapted for placement relative to the shell so that it substantially replaces the removed longitudinal section of the shell. The strain relief member has a rear end which is opposed to and spaced from the rear end of the shell and which includes a projection directed toward the shell. The boot has a reduced diameter end adapted for engaging the rear end of the strain relief member and moving the strain relief member rear end with the projection transversely toward the shell rear end and against the cable. Accordingly, a cable exiting the rear of the shell is engaged by the projection of the strain relief member.

In accordance with an aspect of this invention, the shell includes a projection in its remaining rear portion which is directed toward the strain relief member and is offset longitudinally from the projection of the strain relief member. Further, the projections of the shell and the strain relief member are relatively angularly offset 180° about the shell axis. Accordingly, the cable is engaged by the pair of longitudinally and angularly offset projections to press against and distort the cable for strain relief.

In accordance with another aspect of this invention, either connector further may include a wire termination adaptor assembly including at least one conductive adaptor contact having a first end electrically engagable with a rear end of a respective one of the at least one contact member, and a second end formed as an insulation displacing terminal. The adaptor assembly further includes an insulative adaptor housing selectively insertable into the shell and holding the at least one adaptor contact with its first and second ends extending forwardly and rearwardly, respectively, of the adaptor housing. The adaptor and first contact housings are formed with complementary features to prevent rotation of the adaptor housing with respect to the first contact housing.

BRIEF DESCRIPTION OF THE DRAWINGS

The foregoing will be more readily apparent upon reading the following description in conjunction with the drawings in which like elements in different Figures thereof are identified by the same reference numeral and wherein.

DETAILED DESCRIPTION

Figure 1:
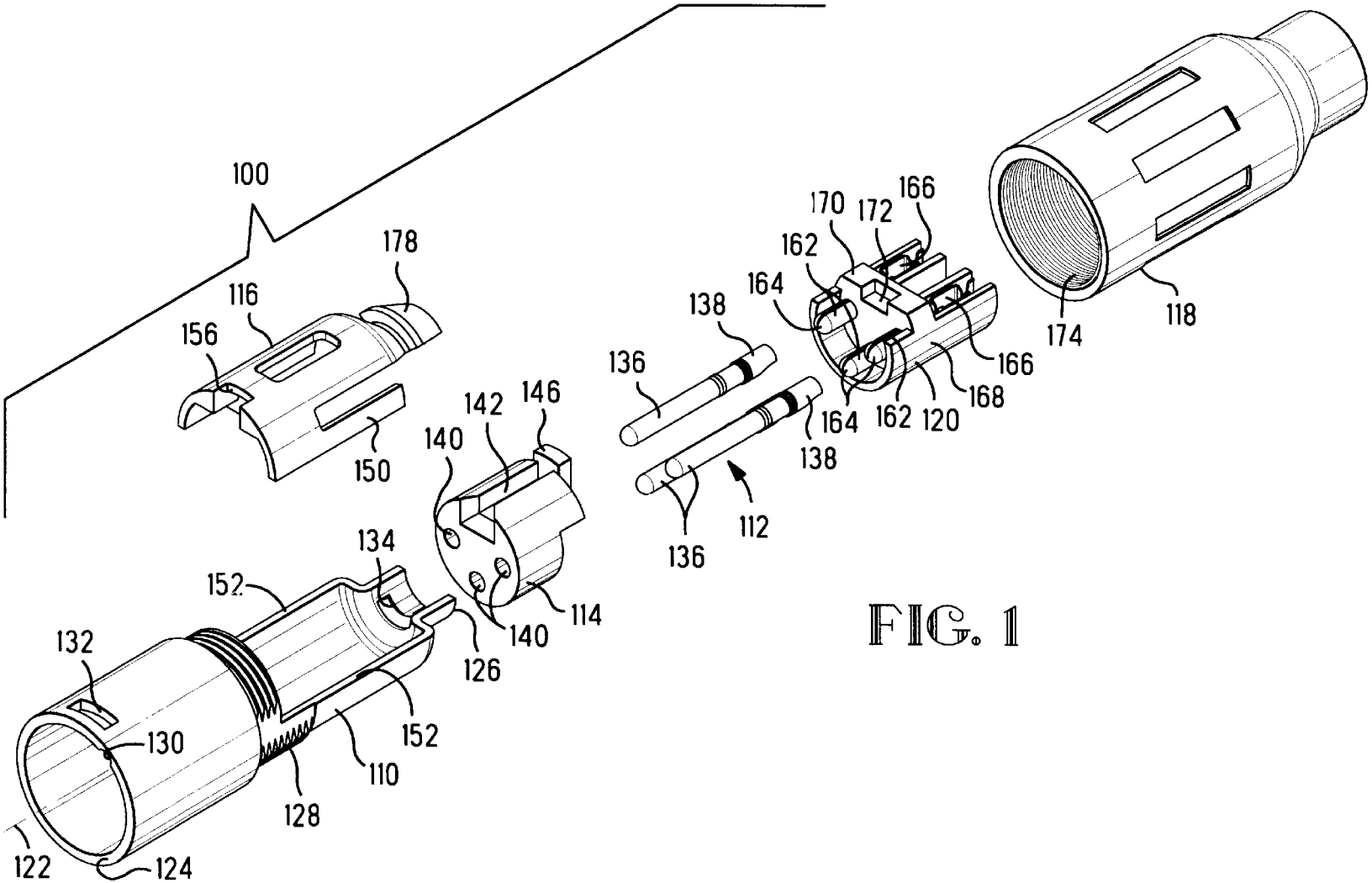
FIG. 1 is an exploded isometric view of a plug subassembly according to the present invention.
Figure 2:
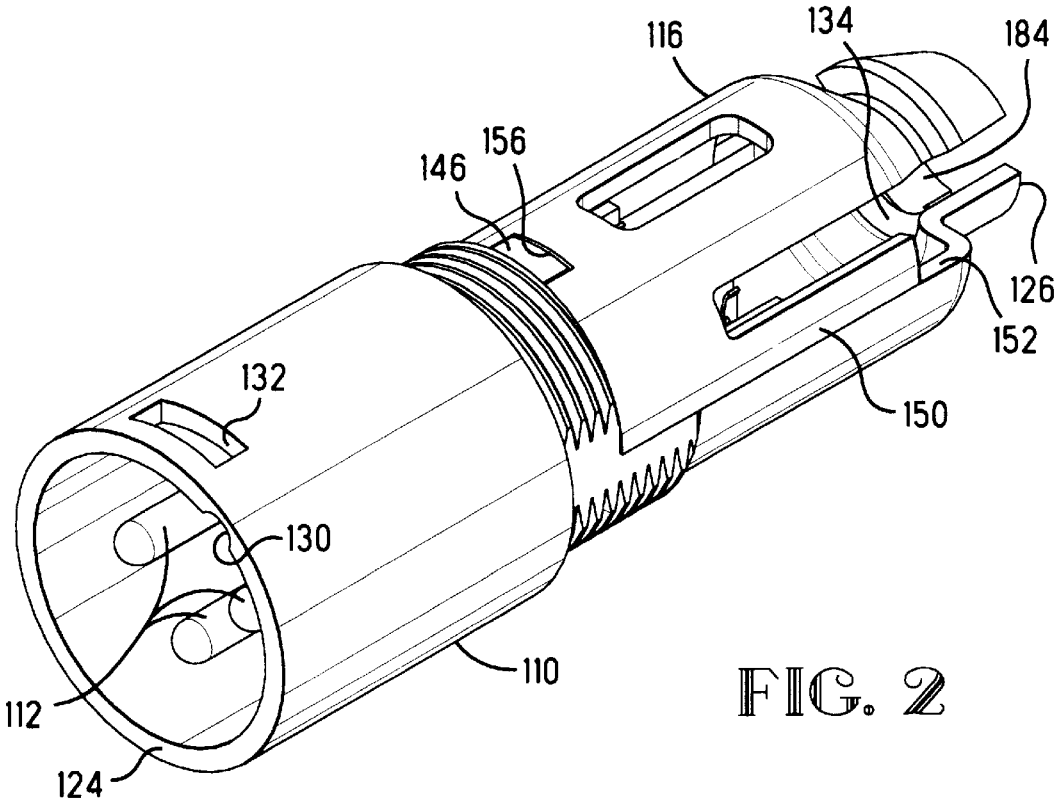
FIG. 2 is a front isometric view of the inventive plug subassembly without the boot.
Figure 3:
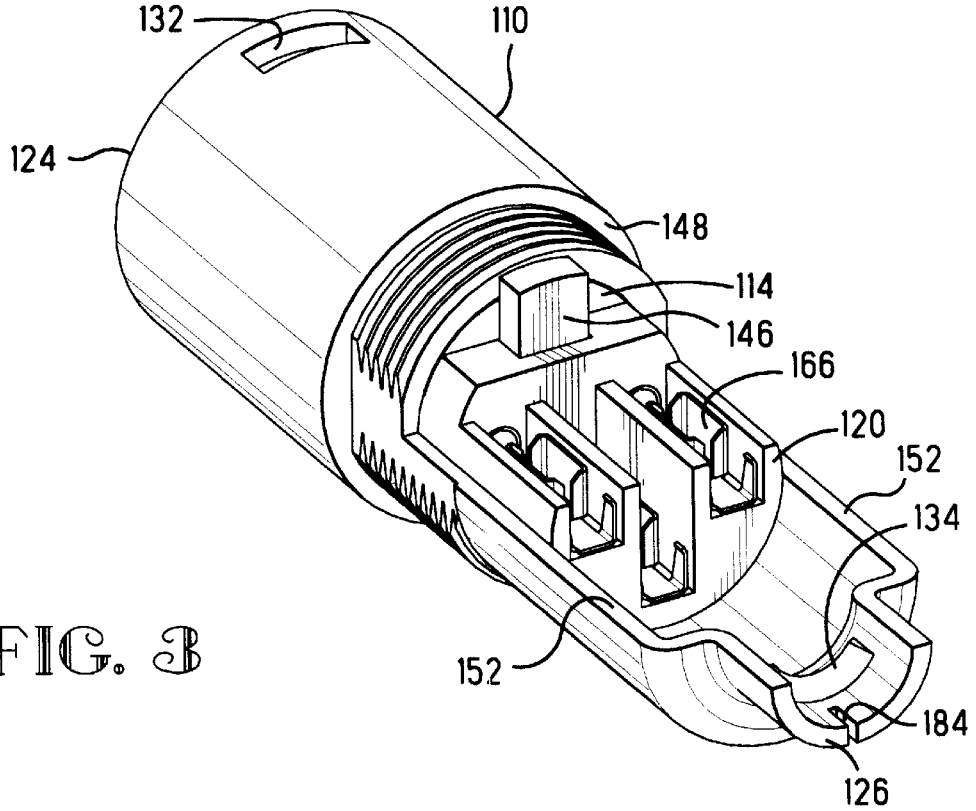
FIG. 3 is a rear isometric view of the inventive plug subassembly without the strain relief member and without the boot.

Electrical connector assemblies typically include a plug subassembly and a receptacle subassembly, each connected to a respective length of cabling, and which subassemblies are complementary so that when mated one with the other respective wires in the two lengths of cabling are interconnected. Referring now to the drawings, the inventive electrical connector assembly includes a plug subassembly, designated generally by the reference numeral 100, and a receptacle subassembly, designated generally by the reference numeral 300, which are matable one with the other. According to the present invention, the subassemblies 100, 300, utilize several common components, as will be described hereinafter, which contributes to reducing the cost of the connector assembly.

As shown in FIG. 1, the plug subassembly 100 includes a plug shell 110, at least one conductive male contact member 112, a contact housing 114, a strain relief member 116, and a boot 118. In addition, FIG. 1 shows a wire termination adaptor 120, which is optional, as will be described hereinafter. Identical strain relief members 116, boots 118, and wire termination adaptors 120 are used in both the plug subassembly 100 and the receptacle subassembly 300.

The plug shell 110 is a generally cylindrical hollow conductive piece defining a longitudinal axis 122 between a forward mating end 124 and a rear end 126. When viewed in sections orthogonal to the axis 122, the shell 110 is shaped as circular arcs of various diameters, the forward portion subtending an angle of 360° and the rear portion subtending an angle of approximately 180°. Further, the plug shell 110 is stepped, with the largest diameter being at the forward mating end 124 and the smallest diameter being at the rear end 126. Thus, the largest diameter portion starting at the forward mating end 124 has a smooth exterior, rearwardly of which is a reduced diameter portion having external threads 128. Rearwardly of the threads 128, the diameter of the plug shell 110 is slightly reduced, followed by a relatively smaller diameter portion terminating at the rear end 126. Starting midway in the threads 128 and continuing to the rear end 126, the plug shell 110 has a longitudinal section removed therefrom, with the remaining portion of the plug shell 110 subtending an arc of approximately 180°. Beginning at the forward mating end 124, and extending rearwardly therefrom, the interior wall of the shell 110 is formed with a longitudinal groove 130 parallel to the axis 122. The groove 130 provides a polarization function for mating with the receptacle subassembly 300, as will be described. Rearwardly of the forward mating end 124, an opening 132, preferably rectangular, is formed through the wall of the plug shell 110. The opening 132 cooperates with a latch member on the receptacle subassembly 300, as will be described. In the reduced diameter portion of the shell 110 just forward of the rear end 126, the interior of the shell 110 is formed with a projection 134 directed toward the axis 122. In longitudinal cross section, the projection 134 is V-shaped and is used for strain relief, as will be described.

Each of the male contact members 112 is an elongated conductive cylindrically shaped member having a forward mating end 136 and a rear connecting end 138. The rear connecting end 138 of each of the contacts 112 is formed as a hollow semi-cylindrical solder cup. To support the contact members 112, the contact housing 114 is formed of insulative material with bores 140 extending longitudinally therethrough to receive respective ones of the contact members 112 therein in a press-fit manner. The contact housing 114 is cylindrical to fit within the plug shell 110 and is formed with a longitudinal slot 142 which is complemental to an internal longitudinal rib 144 (FIG. 4) formed in the interior of the plug shell 110 so that the contact housing 114 is polarized with respect to the plug shell 110 and cannot rotate within the plug shell 110. The contact housing 114 is further formed with an abutment 146 behind the slot 142 which interferes with the "cut" wall 148 of the plug shell 110 to limit forward movement of the contact housing 114 with respect to the plug shell 110.

Figure 4:
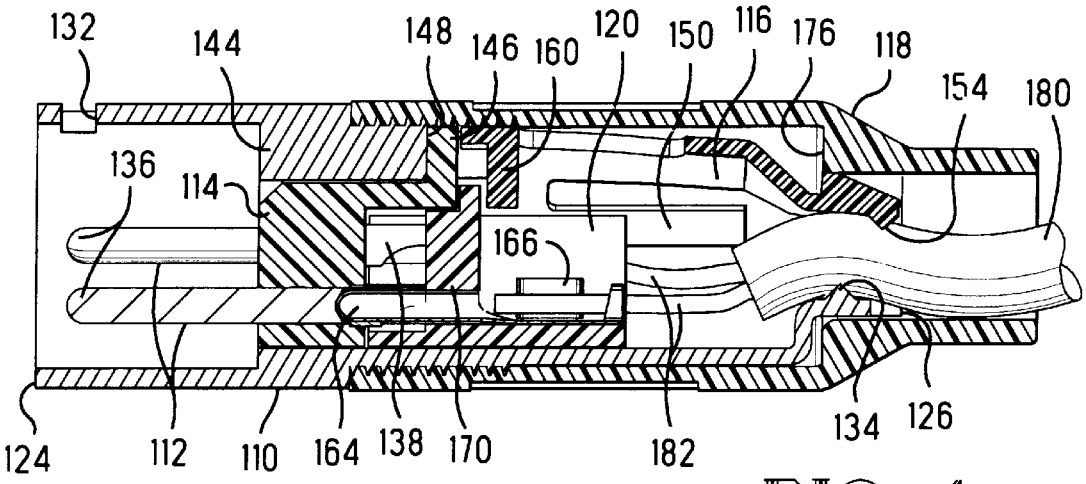
FIG. 4 is a longitudinal cross sectional view of the inventive plug subassembly.
Figure 6:
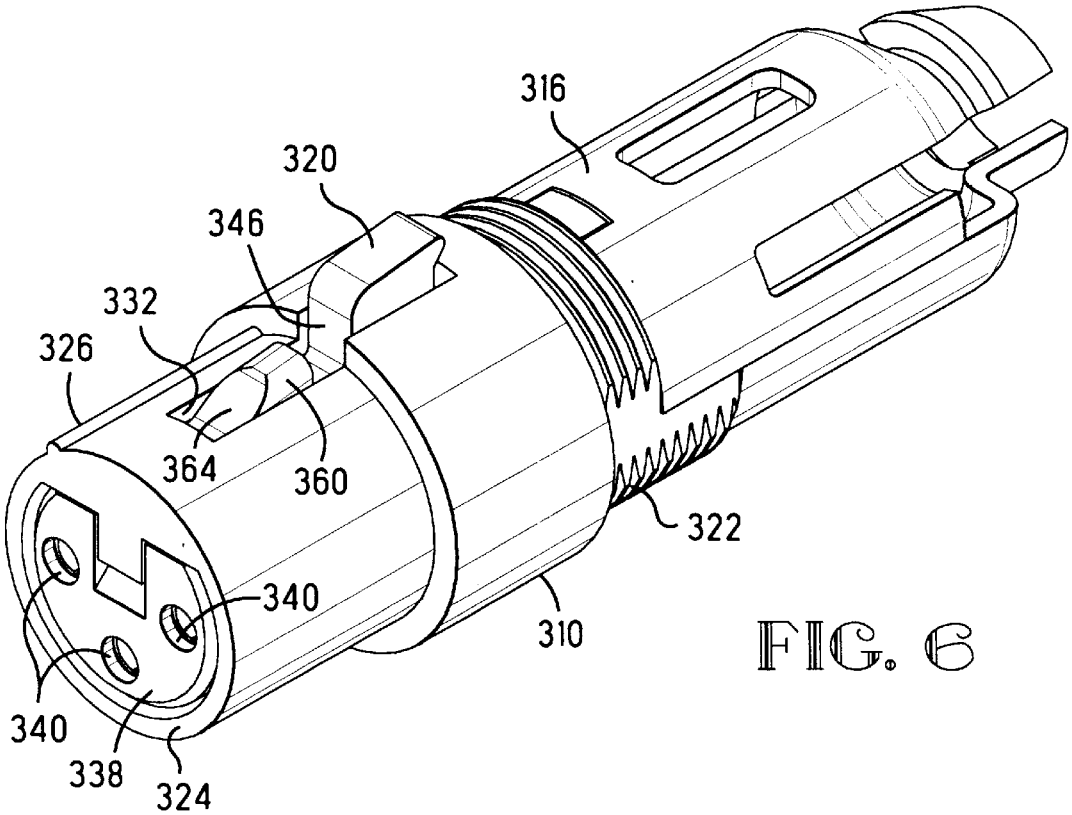
FIG. 6 is a front isometric view of the inventive receptacle subassembly without the boot.
Figure 5:
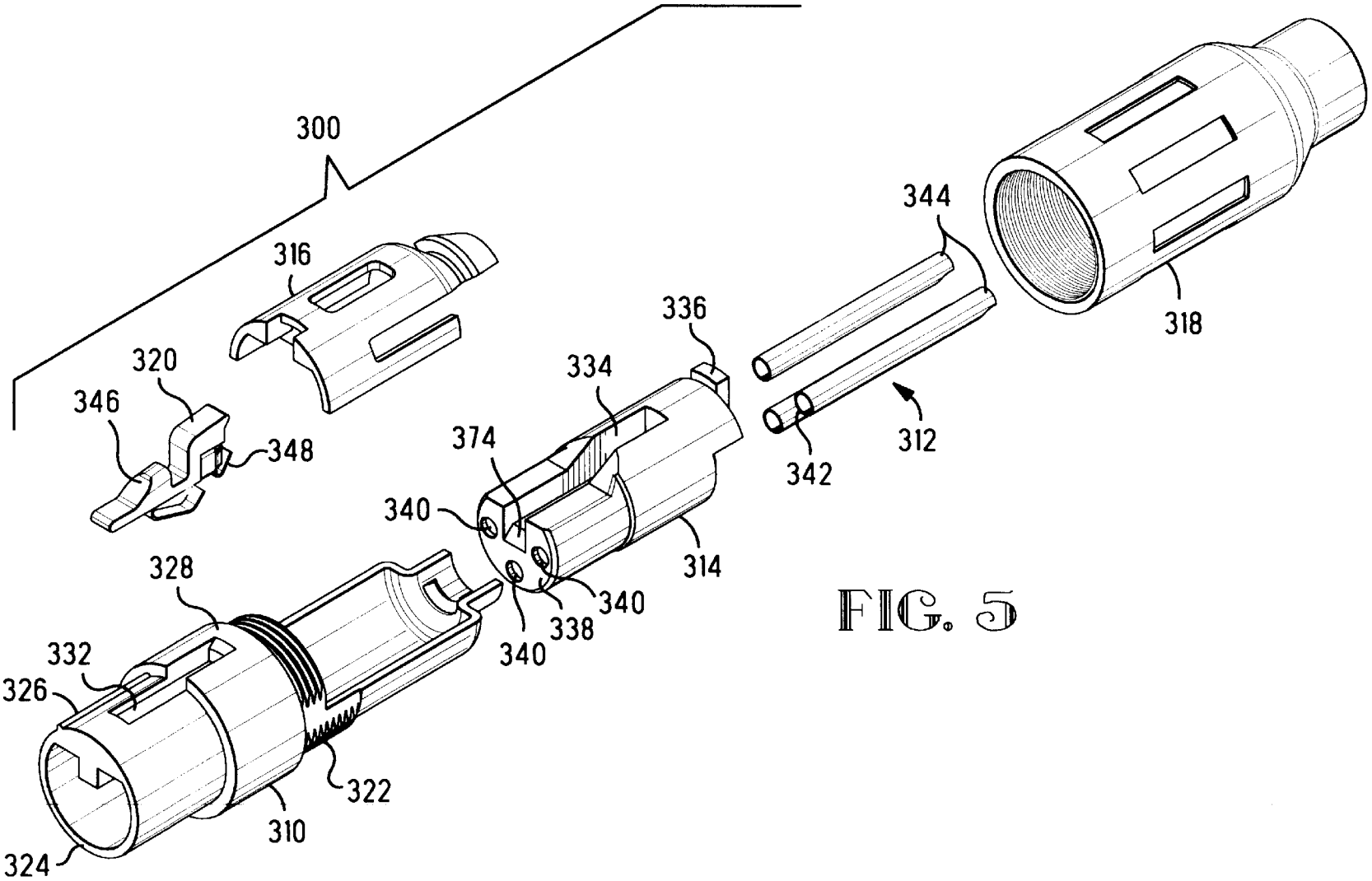
FIG. 5 is an exploded isometric view of a receptacle subassembly according to this invention.
Figure 7:
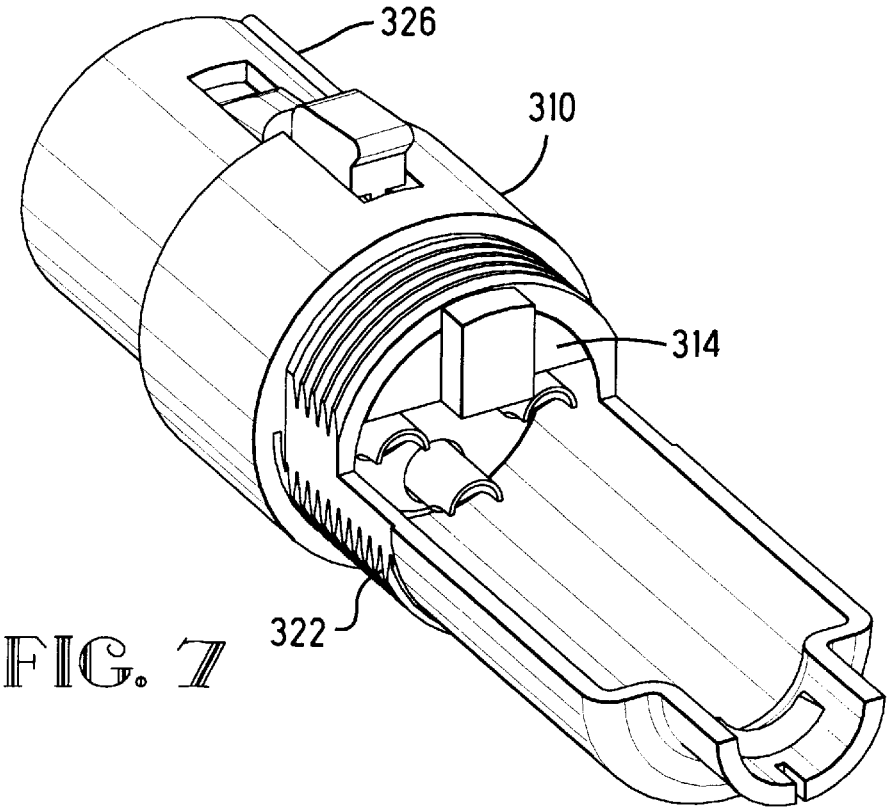
FIG. 7 is a rear isometric view of the inventive receptacle subassembly without the wire termination adaptor assembly, the strain relief member and the boot.

The strain relief member 116 is an insulative generally semi-cylindrical piece, having a pair of rearwardly extending arms 150 which rest on the "cut" longitudinal walls 152 of the plug shell 110. The arms 150 are spaced from the main body of the strain relief member 116, as shown, to allow the rear end of the strain relief member 116 to be flexed toward the projection 134 at the rear of the plug shell 110. Thus, the rear of the strain relief member 116 is formed with an axially directed and V-shaped projection 154 at its rear end. The projections 134 and 154 of the plug shell 110 and the strain relief member 116, respectively, are relatively angularly offset about the axis 122 by 180° and are also relatively longitudinally offset, as best shown in FIG. 4. The forward end of the strain relief member 116 is formed with a notch 156 to accommodate therein the abutment 146. The thickened front wall of the strain relief member 116 prevents the backing out of the contact housing 114. The intermediate wall 160 prevents the backing out of the wire termination adaptor 120, if installed.

The wire termination adaptor 120 is utilized when it is desired to save assembly costs by providing insulation displacing termination for the cable wires, rather than soldered terminations. Thus, the adaptor 120 includes adaptor contacts 162 equal in number to the male contact members 112. Each adaptor contact 162 has a first end 164 engagable in the solder cup end 138 of a respective male contact member 112 and a second end 166 formed as an insulation displacing terminal. The adaptor 120 further includes a housing 168 having a central portion 170 formed with longitudinal bores for receiving respective ones of the adaptor contacts 162 in a press-fit manner. The adaptor housing 168 is sized to fit within the plug shell 110 behind the contact housing 114 so that the adaptor contacts 162 engage respective male contact members 112. The top of the central portion 170 is formed with a notch 172 which engages the abutment 146 to both limit forward movement of the adaptor housing 168 and prevent rotation of the adaptor housing 168 about the axis 122.

The boot 118 is preferably formed of insulative material and is generally cylindrical, and has at its forward end internal threads 174 for engaging the external threads 128 of the plug shell 110. The rear end of the boot 118 is of reduced interior diameter so that as it is screwed onto the threads 128, the forward wall 176 defining the reduced diameter portion engages the outer sloped surface 178 at the rear of the strain relief member 116 to force the projection 154 of the strain relief member 116 radially inward. Therefore, as best shown in FIG. 4, a cable 180 which has its interior wires 182 connected to the contacts 162 (or directly to the contacts 112 if the wire termination adaptor 120 is not utilized) is bent longitudinally into an "S" shape by the angularly and longitudinally offset projections 134, 154, thereby securing and providing strain relief to the cable 180.

In the event that the cable 180 includes a braided shield, the shield is doubled back over the cable 180 and is engaged by the conductive projection 134, thereby providing good contact with the plug shell 110 (which in turn is in contact with the shell of the receptacle subassembly). The rear of the plug shell 110 is formed with a longitudinal slit 184 open to the rear end 126 of the plug shell 110 and extending longitudinally forwardly therefrom. Thus, if the cable 180 includes a bare drain wire, the drain wire is doubled back over the cable 180, passed over the conductive projection 130, and inserted into the slit 184. This provides good electrical contact with the plug shell 110 and also keeps the drain wire in position over the conductive projection 134 as the boot 118 is tightened on the threads 128 by preventing the drain wire from rotating.

The receptacle subassembly 300 bears much similarity to the plug subassembly 100, with their differences being attributable to the fact that they are matingly complemental one with the other. Thus, the receptacle subassembly includes a receptacle shell 310, at least one female contact member 312, a contact housing 314, a strain relief member 316, a boot 318, and a latch 320. The strain relief member 316 and the boot 318 are identical to the strain relief member 116 and the boot 118, respectively, of the plug subassembly 100. In addition, a wire termination adaptor identical to the wire termination adaptor 120 of the plug subassembly may be installed in the receptacle subassembly if it is desired to utilize insulation displacing terminations rather than solder for the cable wires connected to the receptacle subassembly 300.

The receptacle shell 310 is similar to the plug shell 110 and is likewise formed from conductive material. In fact, starting from the threads 322 and rearwardly therefrom they are identical. The forward mating end 324 is of reduced diameter and sized to fit within the hollow forward end of the plug shell 110, with the external rib 326 being complemental to the groove 130 to provide a polarization feature. A longitudinally elongated opening 332 extending through both the reduced and enlarged diameter portions of the receptacle shell 310 is for the purpose of receiving the latch 320, as will be described.

Figure 9:
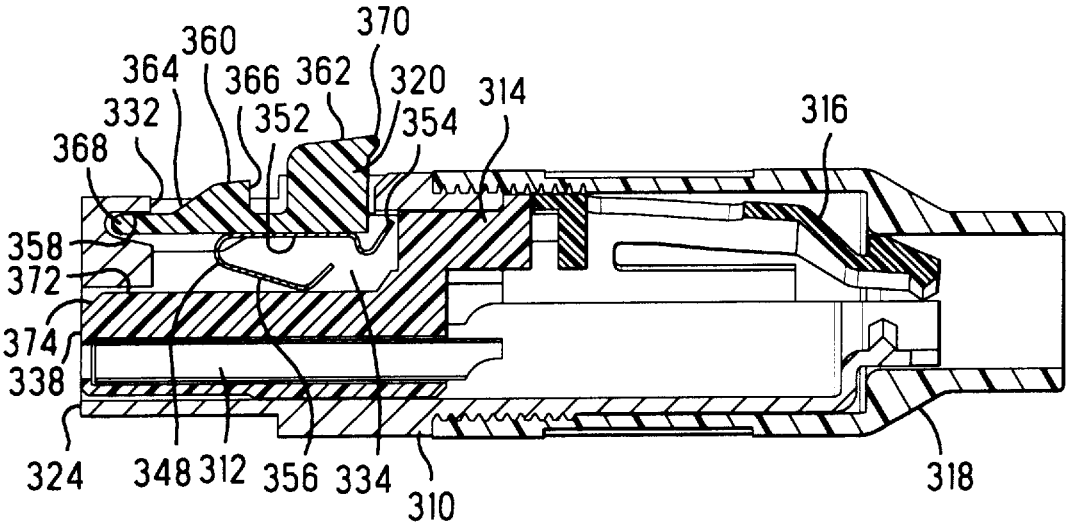
FIG. 9 is a longitudinal cross sectional view of the inventive receptacle subassembly without the wire termination adaptor assembly.
Figure 10:
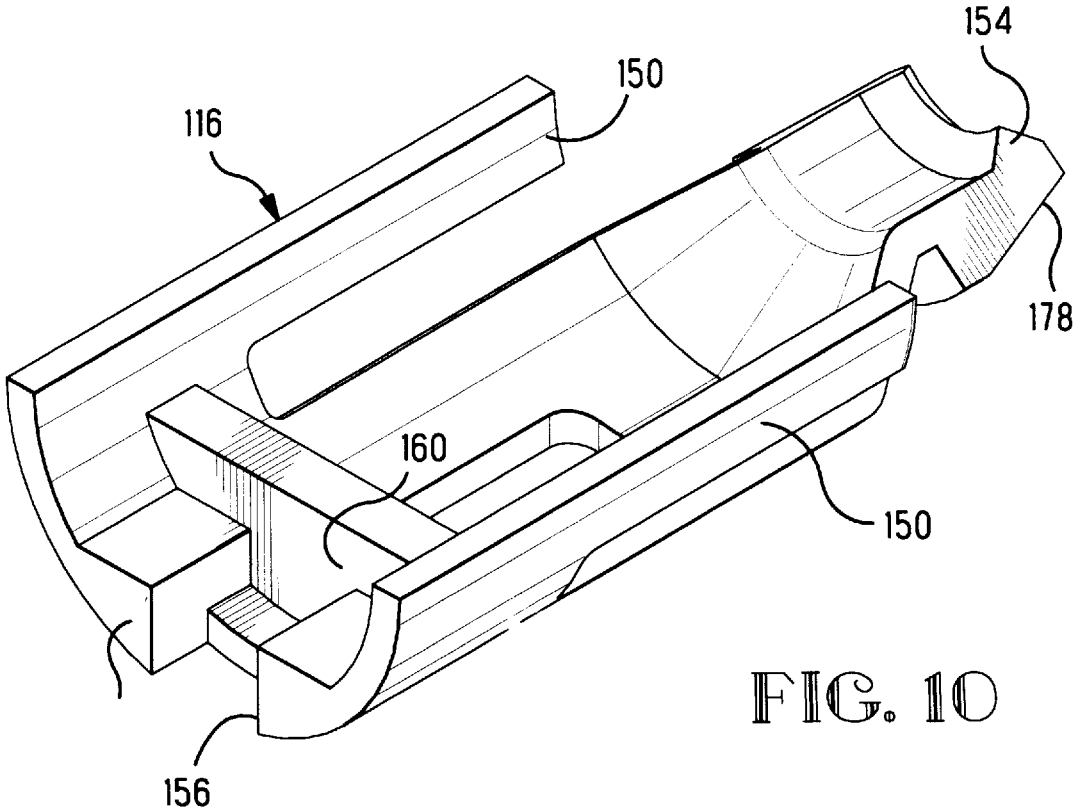
FIG. 10 is an isometric view of the inventive strain relief member.

The receptacle contact housing 314 is formed of insulative plastic and approximately its rear third, including the slot 334 and abutment 336, is identical to the plug contact housing 114. However, the receptacle contact housing 314 is of sufficient length that its front face 338 is substantially flush with the forward mating end 324 of the receptacle shell 310 when the contact housing 314 is installed, as best shown in FIG. 9. The contact housing 314 is formed with at least one contact receiving bore 340 extending longitudinally therethrough and adapted to receive therein a respective one of the female contact members 312 in a press-fit manner. Each of the female contact members 312 is an elongated cylindrical piece having a hollow forward mating end 342 sized to receive therein the forward mating end 136 of a respective male contact member 112 and a rear connecting end 344 formed as a solder cup.

Figure 8:
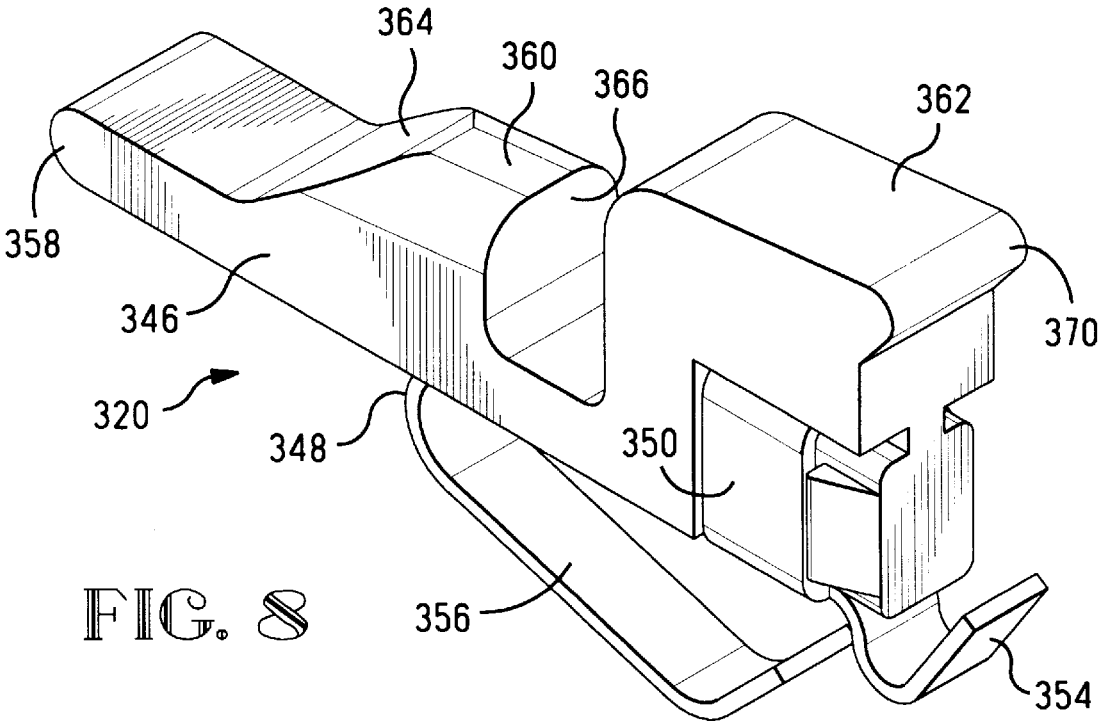
FIG. 8 is an isometric view of a latch installable in the inventive receptacle subassembly.

The latch 320 is comprised of two parts—a molded latch member 346 and a spring 348. As best shown in FIG. 8, the spring 348 is stamped and formed and includes a pair of wings 350 (only one of which is shown) which are bent and wrapped around a portion of the latch member 346 to secure the spring 348 thereto. The spring 348 has a central section 352 which is generally straight and secured to the wings 350. The central section 352 runs along the bottom surface of the latch member 346. Extending from the rear end of the central spring section 352 is a retaining section 354, the function of which will be described hereinafter. Extending from the forward end of the central spring section 352 and bent downwardly and rearwardly therefrom is a force providing section 356, whose function will be described hereinafter.

The latch member 346 has a forward pivot end 358, a central upward abutment 360, and a rear actuator portion 362. The abutment 360 has a forward camming surface 364 and a rear engagement wall 366.

To install the latch 320, the forward pivot end 358 is inserted through the opening 332 of the receptacle shell 310 and into the undercut cavity 368 (FIG. 9). The actuator portion 362 is then pressed downwardly and the retaining section 354 of the spring 348 is flexed forwardly by the rear wall of the opening 332 toward the actuator portion 362 so that it passes through the opening 332. After passing through the opening 332, the retaining section 354 snaps rearwardly to prevent subsequent removal of the latch 320. The actuator portion 362 has a rearwardly extending lip 370 which prevents the latch 320 from falling into the hollow interior of the receptacle shell 310. When the contact housing 314 is subsequently pushed forwardly into the hollow interior of the receptacle shell 310, the slot 334 receives the force providing section 356 of the spring 348. At the forward end of the slot 334, its bottom wall 372 is formed with a camming surface 374 which moves the force providing section 356 of the spring 348 upward. Accordingly, the force providing section 356 engages the bottom wall 372 of the slot 334 to provide an upward biasing force for the latch 320. Thus, when the forward mating end 324 of the receptacle shell 310 is inserted into the forward mating end 124 of the plug shell 110, the forward mating end 124 of the plug shell 110 engages the camming surface 364 of the abutment 360 to move the latch member 346 downwardly against the force of the spring 348. When the abutment 360 enters the opening 132 of the plug shell 110, the latch member 346 snaps upwardly and the rear engagement wall 366 engages the rearwardly facing front wall of the opening 132 of the plug shell 110 to prevent subsequent separation of the plug and receptacle shells. When such separation is desired, the actuator portion 362 of the latch member 346 is pressed downwardly to drop the abutment 360 below the wall of the plug shell 110 so that the shells may be separated.

The boot 318, the strain relief member 316 and the rear of the receptacle shell 310 cooperate in the same way as the corresponding members of the plug subassembly 100 to retain a cable in the receptacle subassembly 300.

Accordingly, there has been disclosed an improved electrical connector assembly which is suitable for use with a cable connected to a microphone. While an exemplary embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. An electrical connector assembly comprising:

a generally cylindrical hollow conductive shell defining a longitudinal shell axis between a forward mating end and a rear end, the outer surface of said shell being circular in section orthogonal to said shell axis and having threads thereon in a region intermediate its forward mating and rear ends, said shell having a longitudinal section removed therefrom rearwardly from said threaded region to said rear end, a remaining rear portion of said shell subtending an arc of approximately 180°;

at least one elongated conductive contact member having a forward mating end and a rear connecting end;

an insulative contact housing sized to fit within said shell forwardly of said removed section and having at least one bore therethrough parallel to said shell axis for receiving said at least one contact member;

an insulative strain relief member of generally semi-cylindrical configuration and adapted for placement relative to said shell so that it substantially replaces the removed longitudinal section of said shell, said strain relief member having a rear end opposed to and spaced from the rear end of said shell and including a projection directed toward said shell; and a hollow generally cylindrical boot affixable to the conductive shell and having a reduced diameter end adapted for engaging the rear end of said strain relief member and moving said strain relief member rear end with said projection transversely toward said shell;

wherein a cable having at least one wire connected to said at least one contact member and exiting the rear of said shell is engaged by said strain relief member projection.

2. The assembly according to claim 1 wherein:

said shell includes a projection in its remaining rear portion which is directed toward said strain relief member and is offset longitudinally from said strain relief member projection; and said shell and strain relief member projections are relatively angularly offset 180° about the shell axis;

whereby said cable is engaged by said pair of longitudinally and angularly offset projections to press against and distort said cable for strain relief.

3. The assembly according to claim 1 further including:

a wire termination adaptor assembly including at least one conductive adaptor contact having a first end engagable with the rear connecting end of a respective one of said at least one contact member and a second end formed as an insulation displacing terminal, said adaptor assembly further including an insulative adaptor housing selectively insertable into said shell, said adaptor housing having at least one bore therethrough parallel to the shell axis for receiving a respective one of the at least one adaptor contact with the first and second ends extending forwardly and rearwardly, respectively, of the adaptor housing, and wherein the adaptor housing and the contact housing are formed with complementary features to prevent rotation of the adaptor housing with respect to the contact housing.

4. The assembly according to claim 1 wherein said shell is formed with a longitudinal slit through the shell wall, open to the rear end of the shell and extending longitudinally forwardly therefrom;

whereby when a cable installed in the assembly includes a drain wire, the drain wire is inserted into the slit to contact the shell and prevent rotation of the drain wire within the shell.

5. The assembly according to claim 1 wherein said contact housing and said shell are formed with complementary features to prevent rotation of said contact housing within said shell and to limit forward movement of said contact housing within said shell.

6. The assembly according to claim 1 wherein said boot has internal threads for engaging the threads of said shell.

7. The assembly according to claim 1 wherein said assembly is a plug connector.

8. The assembly according to claim 1 wherein said assembly is a receptacle connector.

9. The assembly according to claim 1 wherein the shell is formed with a longitudinally elongated slot through its outer wall, the shell outer wall being further formed with a cavity extending forwardly of and below the forward end of said elongated slot, the assembly further including a latch mechanism comprising:

a unitary latch member receivable in said shell elongated slot and including a forward pivot end receivable in said cavity, a central latch element engagable with an opening of a matable connector assembly, and an actuating portion extending outwardly from the shell; and a spring member secured to the bottom of the latch member and engaging the upper surface of the contact housing to pivotably bias the latch member outwardly of the shell.

10. The assembly according to claim 9 wherein the spring member is formed with a portion extending rearwardly of the latch member to interfere with removal of the latch mechanism from the assembly.

11. The assembly according to claim 10 wherein the rearwardly extending portion of the spring member is angled to allow installation of the latch mechanism through the elongated slot in the shell, whereby the spring member angled portion flexes during installation to pass through the elongated slot and then snaps back to prevent subsequent removal.

12. The assembly according to claim 9 wherein the latch member actuating portion is formed with a rearwardly extending projection to prevent the latch mechanism from falling through the elongated slot into the interior of the shell.

13. An electrical connector assembly comprising:

a plug subassembly including:

a generally cylindrical hollow conductive plug shell defining a longitudinal plug shell axis between a forward mating end and a rear end, the outer surface of said plug shell being circular in section orthogonal to said plug shell axis and having threads thereon in a region intermediate its forward mating and rear ends, said plug shell having a longitudinal section removed therefrom rearwardly from said threaded region to said rear end, a remaining rear portion of said plug shell subtending an arc of approximately 180°;

at least one elongated conductive male contact member having a forward mating end and a rear connecting end;

an insulative plug contact housing sized to fit within said plug shell forwardly of said removed section and having at least one bore therethrough parallel to said plug shell axis for receiving a respective one of said at least one male contact member with the forward mating end of said male contact member extending forwardly of said plug contact housing and the rear end of said male contact member extending rearwardly of said plug contact housing, the forward end of said plug contact housing being recessed within said plug shell from the forward mating end of said plug shell to provide a cavity for receiving a mating complementary receptacle subassembly;

an insulative plug strain relief member of generally semi-cylindrical configuration and adapted for placement relative to said plug shell so that it substantially replaces the removed longitudinal section of said plug shell, said plug strain relief member having a rear end opposed to and spaced from the rear end of said plug shell and including a projection directed toward said plug shell; and a hollow generally cylindrical plug boot affixable to the conductive plug shell and having a reduced diameter end adapted for engaging the rear end of said plug strain relief member and moving said plug strain relief member rear end with said projection transversely toward said plug shell;

wherein a first cable having at least one wire connected to a respective one of said at least one male contact member and exiting the rear of said plug shell is engaged by said plug strain relief member projection; and a receptacle subassembly including:

a generally cylindrical hollow conductive receptacle shell defining a longitudinal receptacle shell axis between a forward mating end and a rear end, the outer surface of said receptacle shell being circular in section orthogonal to said receptacle shell axis and having threads thereon in a region intermediate its forward mating and rear ends, said receptacle shell having a longitudinal section removed therefrom rearwardly from said threaded region to said rear end, the remaining rear portion of said receptacle shell subtending an arc of approximately 180°, said receptacle shell having a portion extending rearwardly from said receptacle shell forward mating end which is sized to be longitudinally received within said plug subassembly cavity;

at least one elongated conductive female contact member having a forward mating end and a rear wire receiving end;

an insulative receptacle contact housing sized to fit within said receptacle shell forwardly of said removed section and having at least one bore therethrough parallel to said receptacle shell axis for receiving a respective one of said at least one female contact member with the forward mating end of said contact member remaining within said receptacle contact housing and the rear end of said female contact member extending rearwardly of said receptacle contact housing, the forward end of said receptacle contact housing being substantially aligned with the forward mating end of said receptacle shell;

an insulative receptacle strain relief member of generally semi-cylindrical configuration and adapted for placement relative to said receptacle shell so that it substantially replaces the removed longitudinal section of said receptacle shell, said receptacle strain relief member having a rear end opposed to and spaced from the rear end of said receptacle shell and including a projection directed toward said receptacle shell; and a hollow generally cylindrical receptacle boot affixable to the conductive receptacle shell and having a reduced diameter end adapted for engaging the rear end of said receptacle strain relief member and moving said receptacle strain relief member rear end with said projection transversely toward said receptacle shell;

wherein a second cable having at least one wire connected to a respective one of said at least one female contact member and exiting the rear of said receptacle shell is engaged by said receptacle strain relief member projection.

14. The assembly according to claim 13 wherein:

said plug contact housing and said plug shell are formed with complementary features to prevent rotation of said plug contact housing within said plug shell and to limit forward movement of said plug contact housing within said plug shell; and said receptacle contact housing and said receptacle shell are formed with complementary features to prevent rotation of said receptacle contact housing within said receptacle shell and to limit forward movement of said receptacle contact housing within said receptacle shell.

15. The assembly according to claim 13 wherein:

said plug boot has internal threads for engaging the threads of said plug shell; and said receptacle boot has internal threads for engaging the threads of said receptacle shell.

16. The assembly according to claim 13 wherein said plug and receptacle strain relief members are identical one with the other and said plug and receptacle boots are identical one with the other.

17. The assembly according to claim 13:

wherein each of the plug and receptacle shells includes a projection directed toward its respective strain relief member and offset longitudinally from its respective strain relief member projection; and wherein the shell and strain relief member projections are relatively angularly offset 180° about the shell axis;

whereby said first and second cables are each engaged by a respective pair of longitudinally and angularly offset projections to press against and distort each cable for strain relief.

18. The assembly according to claim 13 further including:

a wire termination adaptor assembly including at least one conductive adaptor contact having a first end engagable with the rear wire receiving end of a selected one of said male and female contact members and a second end formed as an insulation displacing terminal, said adaptor assembly further including an insulative adaptor housing selectively insertable into either said plug shell or said receptacle shell, said adaptor housing having at least one bore therethrough parallel to the shell axis for receiving a respective one of the at least one adaptor contact with the first and second ends extending forwardly and rearwardly, respectively, of the adaptor housing, and wherein the adaptor housing and the plug and receptacle contact housings are formed with complementary features to prevent rotation of the adaptor housing with respect to each of the contact housings.

19. The assembly according to claim 13 wherein each of said plug and receptacle shells is formed with a longitudinal slit through the shell wall, open to the rear end of the respective shell and extending longitudinally forwardly therefrom;

whereby when a cable installed in one of the plug and receptacle subassemblies includes a drain wire, the drain wire is insertable into the slit to contact the shell and prevent rotation of the drain wire within the shell.

20. The assembly according to claim 13 wherein the plug shell is formed with an opening through its outer wall communicating with the plug subassembly cavity and the receptacle shell is formed with a longitudinally elongated slot through its outer wall and extending forwardly into that portion of the receptacle shell received in the plug subassembly cavity and rearwardly toward the receptacle shell threads, the receptacle shell outer wall being further formed with a cavity extending forwardly of and below the forward end of said elongated slot, the receptacle subassembly further including a latch mechanism comprising:

a unitary latch member receivable in said receptacle shell elongated slot and including a forward pivot end receivable in said cavity, a central latch element engagable with the plug shell outer wall opening and an actuating portion extending outwardly from the receptacle shell and rearwardly of that portion of the receptacle shell receivable in the plug subassembly cavity; and a spring member secured to the bottom of the latch member and engaging the upper surface of the receptacle contact housing to pivotably bias the latch member outwardly of the receptacle shell.

21. The assembly according to claim 20 wherein the spring member is formed with a portion extending rearwardly of the latch member to interfere with removal of the latch mechanism from the receptacle subassembly.

22. The assembly according to claim 21 wherein the rearwardly extending portion of the spring member is angled to allow installation of the latch mechanism through the elongated slot in the receptacle shell, whereby the spring member angled portion flexes during installation to pass through the elongated slot and then snaps back to prevent subsequent removal.

23. The assembly according to claim 20 wherein the latch member actuating portion is formed with a rearwardly extending projection to prevent the latch mechanism from falling through the elongated slot into the interior of the receptacle shell.

24. The assembly according to claim 13 wherein:

said plug shell is formed with an interior groove parallel to said plug shell axis and extending rearwardly from said plug shell forward mating end;

said receptacle shell is formed with an exterior rib complemental to said groove, parallel to said receptacle shell axis and extending rearwardly from said receptacle shell forward mating end; and said groove and said rib are angularly positioned about the respective plug and receptacle shell axes to provide a polarizing function for the mating of said plug and receptacle subassemblies.

* * * * *